US009319776B2

(12) United States Patent
Hochleitner

(10) Patent No.: US 9,319,776 B2
(45) Date of Patent: Apr. 19, 2016

(54) ACOUSTIC MANIPULATOR ELEMENT

(76) Inventor: Hubert Hochleitner, Schwaz (AT)

( * ) Notice: Subject to any disclaimer, the term of this patent is extended or adjusted under 35 U.S.C. 154(b) by 360 days.

(21) Appl. No.: 13/518,485

(22) PCT Filed: Jul. 13, 2010

(86) PCT No.: PCT/EP2010/004256
§ 371 (c)(1),
(2), (4) Date: Jul. 30, 2012

(87) PCT Pub. No.: WO2011/076298
PCT Pub. Date: Jun. 30, 2011

(65) Prior Publication Data

US 2012/0308043 A1 Dec. 6, 2012

(30) Foreign Application Priority Data

Dec. 23, 2009 (EP) ..... 09180702

(51) Int. Cl.
*H04R 1/20* (2006.01)
*H04R 1/34* (2006.01)
*G10K 11/20* (2006.01)

(52) U.S. Cl.
CPC ..... *H04R 1/345* (2013.01); *G10K 11/20* (2013.01)

(58) Field of Classification Search
CPC ..... H04R 1/023; H04R 1/34
USPC ..... 381/337, 338, 339, 340
See application file for complete search history.

(56) References Cited

U.S. PATENT DOCUMENTS

| | | | | |
|---|---|---|---|---|
| 3,964,571 | A | 6/1976 | Snell | |
| 5,485,521 | A | 1/1996 | Yagisawa et al. | |
| 6,751,322 | B1 | 6/2004 | Carlbom et al. | |
| 8,396,241 | B2 * | 3/2013 | Satake et al. | 381/337 |
| 2001/0043710 | A1 | 11/2001 | Graf et al. | |
| 2009/0183942 | A1 | 7/2009 | Hawkins | |

FOREIGN PATENT DOCUMENTS

| | | | |
|---|---|---|---|
| DE | 4101752 | A1 | 1/1991 |
| ES | 2 135 335 | A1 | 10/1999 |
| JP | 61-264897 | A | 11/1986 |

OTHER PUBLICATIONS

Communication Pursuant to Article 94(3) EPC, Aug. 19, 2013, European Patent Office, pp. 1-13.

Brandstaett, P. et al., Program for the Computation of Absorptive Silencers in Straight Ducts, Applied Acoustics, Jan. 1, 1994, pp. 19-38, vol. 43, Elsevier Publishing, Great Britain, XP002056193, ISSN: 0003-682X.

* cited by examiner

*Primary Examiner* — Alexander Jamal
(74) *Attorney, Agent, or Firm* — Robert A. Blaha; Smith Tempel Blaha LLC

(57) ABSTRACT

According to an exemplary embodiment of the present invention, an acoustic manipulator element is provided. The acoustic manipulator element is arrangable relatively to an acoustic source in a manner that the acoustic manipulator element splits frequency selectively sound waves originating from the acoustic source in a reflected and a through component, wherein at least a portion of the acoustic waves of the through component is attenuated by at most 15 dB for acoustic frequencies having a wavelength between 200 Hz and 16000 Hz compared to the sound waves of the acoustic source.

10 Claims, 9 Drawing Sheets

ACOUSTIC MANIPULATOR ELEMENT

FIELD OF THE INVENTION

The invention relates to an acoustic manipulator element.

Beyond this, the invention relates to a method for splitting sound waves in a reflected and a through component.

Moreover, the invention relates to a computer-readable medium.

Furthermore, the invention relates to a program element.

BACKGROUND OF THE INVENTION

In the field of sound recording, there are two central problems. First, if the sound deriving from a guitar player is output by a loudspeaker, the guitar player may have a bad impression of the sound by himself as the emission of the sound waves or acoustic waves of the loudspeaker may be inhomogeneous. Second, during recording a guitar, for example, by a microphone (miking), it is difficult to reach and mike a sound of a loudspeaker sounding good.

Both problems are often discussed in various expert's forums. Conventional known systems are unable to solve both problems.

DE 41 01 752 discloses an audio mirror speaker. The audio mirror speaker comprises an uneven area formed on a planar mirror surface. The directivity distribution is controlled by changing the relative position of a speaker diaphragm facing the mirror surface and the mirror. The directivity distribution of such a speaker is determined by the radius of curvature of the uneven area. The directivity changes with movements of the planar mirror.

US 2009/183942 discloses a sound diffuser including a front plate defining a plurality of sound exit holes. An outer frustoconical wall extends from the front plate, the outer frustoconical wall decreasing in diameter from the front plate. An inner frustoconical wall extends from the outer frustoconical wall toward the front plate, the inner frustoconical wall decreasing in diameter toward the front plate and defining a sound entry opening spaced apart from the front plate. A plurality of legs are coupled to at least one of the front plate and the outer frustoconical wall, the legs extending away from the front plate to contact a speaker cover. First and second straps operatively extend from the front plate, the first strap having a distal end with a fastener for connection to a speaker case. The second strap also has a distal end with a fastener for connection to the speaker case.

JP 61264897 discloses a speaker device. The speaker device is adapted for changing a ratio between a rectilinear component and a reflecting component of sound waves radiated by a speaker unit by changing the opening ratio of an aperture part comprised in the speaker device. When the aperture part, which is provided at a diffuser for specified frequency radiated from the speaker unit is fully opened, the response of the sound wave of the rectilinear component passing through the aperture part is made larger than the value of a reflecting component reflected in the diameter direction reflecting on a reflecting body. Also, when the aperture part is opened in half, the response values by the rectilinear component and the reflecting component of the sound wave are nearly equal. Furthermore, when the aperture part is closed, the rectilinear component is disappeared and only the reflecting component is radiated in the diameter direction.

U.S. Pat. No. 3,964,571 discloses an acoustic system for disposition proximate to an acoustical boundary comprising at least one acoustic transducer for directing acoustic energy away from the boundary and an acoustic reflector surface extending, without substantial acoustic discontinuity, from proximate to the center of the transducer to the boundary.

US 2001/043710 discloses an apparatus for picking up sound waves with a separating body and at least two microphones arranged on the separating body. A pick-up which is particularly true to nature is achieved in such a way that the separating body consists of a reverberant material and is provided with a substantially wedge-shaped arrangement, with two separating surfaces which are inclined towards one another at an acute angle, and that the microphones are arranged at a low distance from the separating surfaces.

The known systems for influencing the sound do not solve the above mentioned problems. It is not able to enhance the sound provided to a guitar player, for example, and to enhance the sound provided for miking the sound of a loudspeaker.

OBJECT AND SUMMARY OF THE INVENTION

It is an object of the invention to provide a system for manipulating sound waves for providing an enhanced sound for different applications.

In order to achieve the object defined above, an acoustic manipulator element, a method for splitting sound waves in a reflected and a through component, a program element and a computer-readable medium according to the independent claims are provided.

According to an exemplary embodiment of the invention, an acoustic manipulator element is provided, wherein the acoustic manipulator element is arrangable relatively to an acoustic source in a manner that the acoustic manipulator element splits frequency selectively sound waves originating from the acoustic source in a reflected and a through component. At least a portion of the acoustic waves of the through component is attenuated by at most 15 dB for acoustic frequencies having a wavelength between 200 Hz and 16000 Hz compared to the sound waves of the acoustic source.

According to another exemplary embodiment of the invention, a method for splitting sound waves in a reflected and a through component is provided, wherein the method comprises splitting frequency selectively sound waves originating from an acoustic source in a reflected and a through component, wherein at least a portion of the acoustic waves of the through component is attenuated by at most 15 dB for acoustic frequencies having a wavelength between 200 Hz and 16000 Hz compared to the sound waves of the acoustic source.

According to yet another exemplary embodiment of the invention, a computer-readable medium (for instance a CD, a DVD, a USB stick, a floppy disk or a harddisk) is provided, in which a computer program is stored which, when being executed by a processor, is adapted to control or carry out a splitting method, wherein the method for splitting sound waves in a reflected and a through component comprises splitting frequency selectively sound waves originating from an acoustic source in a reflected and a through component. In one embodiment, at least a portion of the acoustic waves of the through component is attenuated by at most 15 dB for acoustic frequencies having a wavelength between 200 Hz and 16000 Hz compared to the sound waves of the acoustic source.

According to still another exemplary embodiment of the invention, a program element (for instance a software routine, in source code or in executable code) is provided, which, when being executed by a processor, is adapted to control or carry out a splitting method, wherein the method for splitting sound waves in a reflected and a through component comprises splitting frequency selectively sound waves originating from an acoustic source in a reflected and a through component. In one embodiment, at least a portion of the acoustic waves of the through component is attenuated by at most 15 dB for acoustic frequencies having a wavelength between 200 Hz and 16000 Hz compared to the sound waves of the acoustic source.

Splitting sound waves in a reflected and a through component which may be performed according to embodiments of the invention can be realized by a computer program, that is by software, or by using one or more special electronic optimization circuits, that is in hardware, or in hybrid form, that is by means of software components and hardware components.

According to an embodiment of the invention, it may be possible to split frequency selectively sound waves originating from an acoustic source in a reflected and a through component. At least a portion of the through component may be attenuated by at most 15 dB for acoustic frequencies having a wavelength between 200 Hz and 16000 Hz compared to the sound waves of the acoustic source.

The term "acoustic manipulator element" may denote any kind of element which is able to manipulate sound waves originating from an acoustic source. For manipulating sound waves, the acoustic manipulator element may be arrangable relatively to an acoustic source in a manner that the acoustic manipulator element splits frequency selectively sound waves originating from the acoustic source in a reflected and a through component.

The term "sound waves" may denote sound waves or acoustic waves, which originate from an acoustic source. The acoustic or sound source may be for example a loudspeaker, which outputs sound of a guitar, for example. The sound waves may serve as input or incoming signal.

The term "frequency selectively" may denote that the sound waves may be split according to frequencies, wherein a predefined part of frequencies may be allocated to the reflected component and another predefined part of frequencies may be allocated to the through component.

The term "reflected component" may denote a component or part of the sound waves, which may perform a change in direction at an interface between two different media, in this case between the environment of the loudspeaker, for example air, and the acoustic manipulator element, so that the sound wave returns into the medium from which it originated. For example, sound waves having frequencies in the range of 200 Hz to 16000 Hz may be reflected, wherein between about 10% and 90% of the sound wave intensities may be reflected and between about 10% and 90% of the sound wave intensities may be transmitted through the acoustic manipulator element. In one embodiment, between 10% and Y % of the sound waves having frequencies between 1 kHz and 8 kHz may be reflected, and/or between 10% and 90% of the sound waves having frequencies between 8 kHz and 16 kHz may be reflected. The percentages and the frequency ranges may vary depending for example on the shape and size of the acoustic manipulator element.

The term "through component" may denote a component or part of the sound waves, which may be transmitted through the acoustic manipulator element in contrast to the reflected component. During the transmission through the acoustic manipulator element, the through component or at least a portion of the acoustic waves of the through component may be attenuated by at most 15 dB compared to the sound waves of the acoustic source. This attenuation may be valid for acoustic frequencies having a wavelength between 200 Hz and 16000 Hz .

The term "at least a portion of the acoustic waves of the through component" may be optional. Also all of the acoustic waves of the through component for acoustic frequencies having a wavelength between 200 Hz and 16000 Hz may be attenuated. "For acoustic frequencies having a wavelength between 200 Hz and 16000 Hz " may denote that acoustic waves having frequencies in this range may be manipulated. 10% of the acoustic waves may be reflected by and 10% of acoustic waves may be transmitted through the acoustic manipulator element, wherein the percentage may be optional.

With the above mentioned manipulator element, it may be possible to deflect specific portions of the hearable frequency spectrum of the sound. This may result on the one hand in that desired frequencies are provided additionally to a microphone or a listener, whose position is out of the sound axis of a sound source, and that desirable staining of the sound may occur due to interferences of direct components and reflected components of the sound. This may also be used for a plug in for a computer using the above mentioned program element. On the other hand, specific frequencies are provided to a listener positioned in the sound axis only in an attenuated form.

It may be particularly desirable to manipulate frequencies in the range of 4000 Hz +/− one octave, that is in the range of 2000 Hz to 8000 Hz. The human sense of hearing is most tender at approximately 4000 Hz. Loud sound levels may be sensed as very painful especially at this frequency range. In particular, the frequencies in the range of 2000 Hz to 8000 Hz may be attenuated by at most 15 dB, in particular from 3 dB to 6 dB, or by at most 3 dB. The frequencies may be attenuated by any attenuation between 0 dB and 15 dB, in particular by an attenuation of more than 0 dB, more particularly by any attenuation between 1 dB and 15 dB.

Also frequencies in the range of 200 Hz to 16000 Hz may be manipulated by an acoustic manipulator element having the above mentioned features. The acoustic manipulator element may also be used as noise protection, wherein low frequencies may be deflected, wherein higher frequencies may be diffused. The frequencies in the range of 200 Hz to 16000 Hz may be attenuated by at most 15 dB, in particular by 3 dB to 6 dB, or by at most 3 dB. The frequencies may be attenuated by any attenuation between 0 dB and 15 dB. In one embodiment, frequencies of 200 Hz may pass through the acoustic manipulator element without any attenuation. Also frequencies below 200 Hz and above 16000 Hz may be attenuated, depending on the case of application.

In sound studios, sound signals may be recorded digital directly on a hard drive of a computer via suitable software. Such a software may also comprise virtual instruments for playing music. This method is called "modelling". Also guitar amplifiers, loudspeakers or microphones may be selected. The virtual instruments may be comprised in the software as "plug-ins". The manipulating or splitting of sound waves into a reflected and a through component may also be realized by such a software.

With regard to a computer-readable medium or a program element according to embodiments of the invention, the acoustic effects of the proposed acoustic manipulator element and the method may be simulated electronically or by the use of software. For this purpose, parts of the frequencies of the original signal may be reduced and/or the signal may be split multiple times and each split part may be mixed up with the original signal, wherein the split parts may be modified by changing the phasing or adding small time shifts.

A way to simulate the proposed method may be to position a microphone in front of a loudspeaker. The resulting sound signal, recorded by the microphone, may be modified by reducing or increasing appropriate frequencies, for example by a tone controller or an equalizer. With this method, the real environment is only modelled in an inappropriate way, as no information about for example the used materials, acoustic environments or natural resonant frequencies are included in the simulation.

Instead of using a microphone for recording a sound signal, an instrument, for example an electric guitar, may be coupled directly with a computer. The computer may comprise an A/D converter for converting the analog sound signal into a digital signal. The digital signal may then be processed by a tone controller, an equalizer or any other software implementation.

There exist at least two further methods for simulating the proposed acoustic manipulator element and the corresponding method in a better way. The first method uses impulse responses. In this first method, short impulses are directed into a room and the echo characteristics of the room are recorded via a microphone. These characteristics are encoded by software and by using a convolution reverb, the echo or reverb of any desired building, whose characteristics have been recorded, may be simulated.

Convolution reverb is a process for digitally simulating the reverberation of a physical or virtual space. It is based on the mathematical convolution operation, and uses a pre-recorded audio sample of the impulse response of the space being modelled. To apply the reverberation effect, the impulse-response recording is first stored in a digital signal-processing system. This is then convolved with the incoming audio signal to be processed. The process of convolution multiplies each sample of the audio to be processed (reverberated) with the samples in the impulse response file.

The second known method is called Sweep. In this method, instead of using an impulse, a complete frequency range is swept or sampled and the response is digitally stored. Also both methods could be combined.

With these methods, the acoustic manipulator element and the corresponding method may be simulated by software. Thus, a computer-readable medium and a program element may be provided which are suitable for simulating the acoustic manipulator element and the corresponding method according to embodiments of the invention.

In the following, further exemplary embodiments of the acoustic manipulator element will be explained. However, these embodiments also apply to the method, to the program element and to the computer-readable medium.

The acoustic manipulator element may comprise a base plate. The base plate may be a thin plate. It may also be a curved thin plate. The base plate may also be any kind of hollow or solid body, like a rectangular prism or cube, wherein one side of the body is oriented toward the acoustic source or loudspeaker. The base plate may be a reflector plate. The base plate may be arranged in front of the sound source, for example a loudspeaker. Shrill frequencies, for example 2858 Hz, may be hearable in sound axis if the base plate has a surface with a dimension or diameter of less than 12 cm. If the base plate has a surface with a dimension or diameter of more than 17 cm, the desired attenuation of the frequencies may be achieved, for example to 2017 Hz. The base plate may be rectangular-shaped, polyangular-shaped, circular-shaped or oval-shaped.

The base plate may be parallel or arranged in an angle in respect to the acoustic source. The effective dimensions of the base plate as seen from the acoustic source (for example dimension*cos(enclosed angle)) may be relevant.

The base plate may form a cone, in particular a hollow half cone. This form may be used if a portion of the sound should be deflected in one direction but in an attenuated form. The deflection may be diffuse. The base plate may also be in the form of a sphere. A portion of the sphere may be cut off so that the base plate is more in the form of a hemisphere or more or less than a hemisphere.

The base plate may be half cone shaped and the half cone may be hollow and divided in two or more portions, wherein the portions may be folded relatively to another. This form may also be used if a portion of the sound should be deflected in one direction but in an attenuated form. The deflection may be diffuse. The cone may be divided from the top to the basis. Further, the half cone may also be more than a half of the cone or less than a half of the cone. The lateral surface of the cone may be also be convex or concave.

The base plate may be arranged relative to the sound source in a specific angle for reducing a sound level of the sound waves. The angle between base plate and the sound source may vary. A flat angle may reduce the sound level in a slight extent. A sharper angle may enhance the attenuation of the noise level, the interferences between sound source and acoustic manipulator element may increase and the sound may thus be noticeable distorted. A preferred angle may be 50°. If the acoustic manipulator element is arranged immediately in front of the acoustic source, the interferences may increase due to the repeated reflection between sound source or acoustic source and the acoustic manipulator element and the sound may be distorted.

The acoustic manipulator element may comprise a second base plate, wherein the base plate may be arranged relatively to the second base plate. The first and/or the second base plate may serve as a diffuser or the base plates may provide a specific reflected and through component due to the specific arrangement. The base plate and the second base plate may be in any form as described herein, wherein all surfaces, edges and/or bases may be curved, for example convex or concave.

The base plate may be curved and/or the base plate may comprise at least two portions, wherein the at least two portions may be arranged with a gap. That means that the base plate may be curved convex or concave. Further, if the base plate comprises at least two portions, these portions may be arranged with a specific angle in between. The base plate may be in a calotte form and/or may comprise two plates, angled but forming flat surfaces. Depending on the form, the sound may be deflected in a specific direction in a varyingly strong way. The diffuser, which is arranged closer to the sound source, may be smaller than the second diffuser. Thus, the smaller diffuser may deflect high frequencies in a desired direction, wherein the bigger one may deflect lower frequencies in another desired direction Further, the base plate may comprise apertures. With these embodiments, a part of the frequencies may pass through the acoustic manipulator element without diffraction. After the acoustic manipulator element, a spheric wave may occur, according to the Huygens-Fresnel principle. The Huygens-Fresnel principle is a method of analysis applied to problems of wave propagation (both in the far field limit and near field diffraction). It recognizes that each point of an advancing wave front is in fact the center of a fresh disturbance and the source of a new train of waves; and that the advancing wave as a whole may be regarded as the sum of all the secondary waves arising from points in the medium already traversed.

In a further embodiment, the acoustic manipulator element may be provided without such apertures. That means that the base plate may be aperture-free or hole-free.

The acoustic manipulator element may comprise a first element as base plate and a second element attached to the first element as diffuser. With this embodiment, it may be achieved that additionally portions of the sound waves are diffused. The first element may be of a smooth plastic material, like acrylic glass, and the second element may be of carton. The elements may also consist of any kind of plastic material, carbon fiber, wood (nature or varnished), metal or a combination of these materials. The channel, which is formed between the plates or elements, may be used for a directed deflection or diversion (focusing) of the sound. If the distance between the elements is increased, an amplification effect or trumpet effect may occur. If the distance is decreased, the distance may act as a damper or attenuator. In addition, interferences may occur which may be used for example for miking. The beam reflected to the top may be further divided. If a microphone is arranged laterally, sound waves having higher frequencies may be specifically directed towards such a microphone.

The second element may for example be in any form as described in correspondence with the base plate. It may be for example in the form of a hemisphere, a half cone or a pyramid.

The first element may be rectangular-shaped and the second element may comprise two triangle-shaped portions forming a pyramid-shaped attachment to the first element. This form may be used if a portion of the sound should be deflected in one direction but in an attenuated form. A pyramid in this sense may be polyhedron formed by connecting a polygonal base and a point, called the apex. Each base edge and apex forms a triangle. It is a conic solid with polygonal base.

The first element may be rectangular shaped and may comprise a triangle-shaped cutout and the second element may be pyramid-shaped with an open bottom and one open side surface, and the second element may be attached to the first element such that the open bottom of the second element corresponds to the cutout of the first element. With such an embodiment, various designs of the sound may be achieved by attaching the microphone at different parts of the acoustic manipulator element. The first element may be cone-shaped and the second element may be attached to at least a portion of the first element as a wing. The wing in this embodiment may serve as a diffuser.

The base plate in this embodiment may have dimensions of a length in a range of 40 cm to 60 cm and a width in a range of 20 cm to 40 cm. The dimensions may further be about 50 cm by 30 cm, in particular 51 cm by 30 cm. One side, for example the smaller side, may comprise a cut out in the form of a triangle having a base in a range of 10 cm to 30 cm, for example about 20 cm, in particular 23 cm, and a height in a range of 30 cm to 50 cm, for example of about 40 cm, in particular 42 cm. On top of the cut out area, a diffuser may be attached to the base plate. The diffuser may be in the form of a pyramid. The pyramid may have a height in a range of 40 cm to 60 cm, for example of about less than 50 cm, in particular 49 cm, and the length of the diagonal of the base may be in the range of 10 cm to 30 cm, for example about 25 cm, in particular 27 cm.

The base plate may also have a length of more than 60 cm, for example more than 100 cm, to be used for loudspeakers of a higher height. Also two or more acoustic manipulator elements may be arranged one superimposed on the other. Such an arrangement may be formed by using a tripod or stand.

The acoustic manipulator element may comprise a first and a second diffuser attached to the base plate. In this further embodiment, a second diffuser, for example pyramid-shaped, may be attached to the base plate in addition to the first diffuser. The top of the second diffuser may be arranged for example next to the top of the first diffuser. The second diffuser may be arranged overlapping the first diffuser at least partly. The first diffuser may be used for loudspeakers being arranged in a greater height and the second diffuser may be used for loudspeakers being arranged in a lower height. Therefore, the same acoustic manipulator element may be used for different loudspeakers having different heights or for loudspeaker systems comprising more than one loudspeaker arranged in different heights.

The acoustic manipulator may be arranged such that the base plate may be tilted in angle, for example in a range of 40 degree to 60 degree, in particular of about 50 degree, to the sound source, wherein the side of the base plate facing the ground is arranged nearer to the sound source and the opposite side, facing away from the ground, is arranged farer away from the sound source. By such an embodiment, it may be achieved that the sound waves are not reflected towards the ground but are reflected away from the ground. Further, a diffuser may be used being adapted to reflect the sound waves not only in a direction away from the ground, but also towards the sides.

The first element may be pyramid-shaped and the second element may be rectangular shaped and attached to the first element on top of the pyramid. By this embodiment, also various possibilities of sound design may be achieved. The second element may be arranged symmetrically in the middle on top of the first element. It may also be arranged asymmetrically on one side on top of the first element.

The forms comprising a first and a second element may also comprise a base plate, wherein the first element may be attached to the base plate.

A damping material may be applied to a surface of the acoustic manipulator element. The damping material may be for example foam, gum or cloth material. The whole surface of the acoustic manipulator element may be of such a material or only parts of it, for example only the diffuser element or only the base plate or parts of them. The base plate and/or the diffuser may comprise small geometric shapes or indentations for deflect sound diffusely. The geometric shapes may be pyramids, half cylinder, or similar shapes.

The acoustic manipulator element may be adapted for providing the reflected component to a microphone. The reflected component may provide desired frequencies additionally to a direct component of the sound waves to the microphone. By interferences of direct and reflected components, a change of the sound may be achieved. This may be used for miking. The term "miking" may denote placing a microphone for recording and amplification. There are several classes of microphone placement for recording and amplification. In close miking, a microphone may be placed relatively close to an instrument or sound source. In ambient or distant miking, a microphone may be placed at some distance from the sound source.

The acoustic manipulator element may be adapted for providing the through component to an auditor. Thus, specific frequencies may be provided to the auditor or listener. In addition, it may be avoided that other frequencies are provided to the auditor, for example if these frequencies would provide a shrill sound.

The acoustic manipulator element may comprise at least one mark for marking a position of a microphone attachable to the acoustic manipulator element for receiving the reflected and/or the through component in a predetermined manner. In this manner, it may be easy for a user to choose the right position for different applications. The acoustic manipulator element may also comprise a holder for microphones so that external holders may be omitted. Microphones may also be mounted directly on the acoustic manipulator element, for example boundary or interface microphones.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
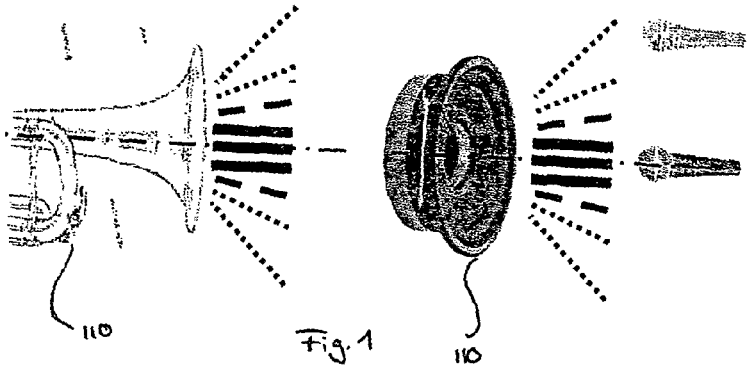
FIG. 1 illustrates a conventional sound source.

The illustration in the drawing is schematically. In different drawings, similar or identical elements are provided with the same reference signs.

An acoustic manipulator element according to an embodiment of the invention may be used together with sound or acoustic sources, which deflect higher frequency sound highly focused due to the design. This effect may occur for example at a trumpet 110, where a sharp, shrill sound may be heard in the sound axis, wherein the sound outside the sound axis comprises too little high frequencies. This directed sound deflection may also occur at loudspeakers 110 due to their design, for example when using a cone loudspeaker. This may been for example in FIG. 1, wherein thick, drawn through lines represent high frequencies with high intensity, dashed and finely dashed lines represent high frequencies with low intensity.

Figure 2:
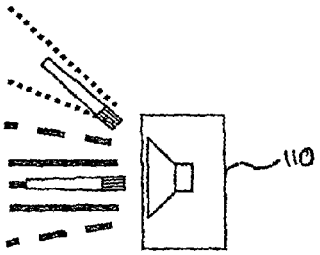
FIG. 2 illustrates a conventional sound source with positioned microphone.

When recording or miking such a sound source, it may be difficult to position a microphone in a manner that a balanced sound is achieved. If a microphone is aligned in the sound axis, high frequencies (more than 1 kHz) may be overemphasized, the sound is shrill and unnatural ("beam effect"). If the microphone is positioned to far away from the sound axis, high frequencies are barely apprehended so that the sound is too muffled. This is shown in FIG. 2. In such a configuration, the microphone has to be positioned closed to the sound source leading to a limited number of acoustic colours.

Figure 3A:
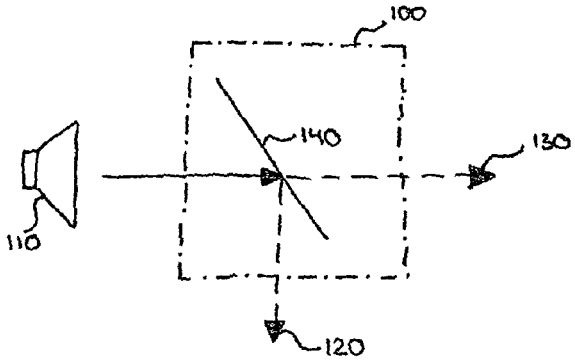
FIGS. 3*a* to 3*g* illustrate embodiments of an acoustic manipulator element according to the invention.
Figure 3B:
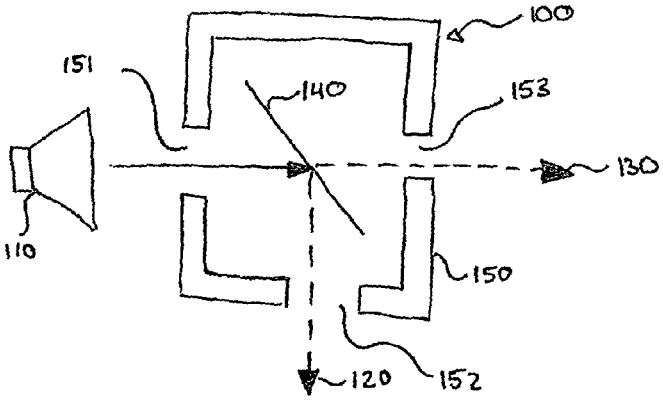

According to an embodiment of the invention illustrated in FIG. 3*a*, an acoustic manipulator element 100 is provided, which is arrangable relatively to an acoustic source 110 in a manner that the acoustic manipulator element splits frequency selectively sound waves originating from the acoustic source in a reflected 120 and a through component 130. At least a portion of the acoustic waves of the through component is attenuated by at most 15 dB for acoustic frequencies having a wavelength between 200 Hz and 16000 Hz compared to the sound waves of the acoustic source. The acoustic manipulator element may consist in this embodiment of a base plate 140. A portion of the sound waves is reflected at the base plate 140 providing a reflected component. A further portion of the sound waves is transmitted through the acoustic manipulator element 100 and the base plate 140 providing a through component 130. The through component 130 may be provided for example to an auditor, the reflected component 120 may be provided for example to a microphone. The acoustic manipulator element 100 may also be arranged within a housing 150, as illustrated in FIG. 3*b*. The housing may comprise at least three openings. In this embodiment, the first opening 151 is arranged for receiving the sound waves of the sound source. The second opening 152 is arranged for passing the reflected component to the outside of the housing. The third opening 153 is arranged for passing the through component to the outside of the housing.

In the FIGS. 3*c* to 3*g*, the reflected component and a position of a microphone is shown only for illustrating purposes. The figures are not limited to the reflected component and a microphone, but a through component of the sound waves also exists in these embodiments.

Figure 3C:
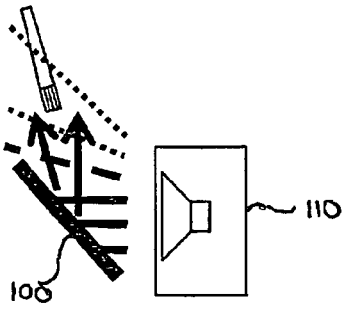
Figure 3D:
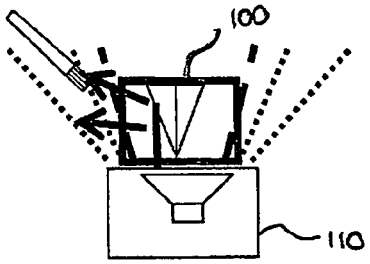

By positioning the acoustic manipulator element 100, desired portions of high frequencies are reflected or deflected towards the microphone, shown in FIG. 3*c*. By choosing the reflective surface, form or shape, texture of the surface, angle and size of the acoustic manipulator element in an appropriate way, the desired frequencies are reflected, deflected or transmitted through the acoustic manipulator element in a specific and defined manner, see FIG. 3*d*. By using an acoustic manipulator element according to the invention, the number of acoustic colours may be increased.

Depending on the relative positions of the microphone, the acoustic manipulator element and the sound source, sound waves meet the microphone directly or indirectly leading to interferences and acoustic colouring. This effect is dependent on the distance between the microphone, the acoustic manipulator element and the sound source, that means it may be stronger or weaker, and may be used for specifically influencing the sound. Also the angle, in which the sound (direct or through component and reflected component) impinges on the microphone influences the acoustic. Thus, the effective surface of the acoustic manipulator element is relevant, which may be seen from the sound source.

Figure 3E:
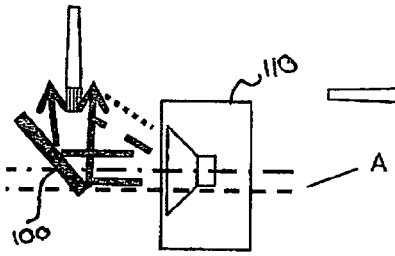

According to an embodiment of the invention, in FIG. 3*e*, a base plate 140 may be used as acoustic manipulator element 100. The base plate may be arranged in an angle in respect to the sound source and extends at least to the position, where higher frequent sound waves occur (shown by the letter A in FIG. 3*e*). The higher frequent sound in this case is mainly reflected to the top.

Figure 3F:
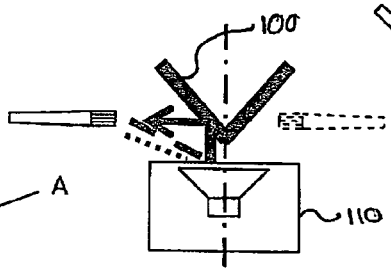
Figure 3G:
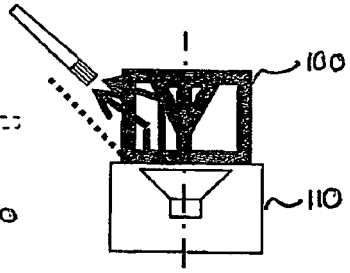

For example symmetrical shapes may be used as acoustic manipulator element 100 when using more than one microphone (FIG. 3*f*). In this case, the acoustic manipulator element forms a triangle. By adding further reflecting surfaces, the space usable for miking may be increased (FIG. 3*g*).

Sound waves have a specific wavelength dependent on the frequency. A sound wave having a frequency of 4 kHz corresponds to a wavelength of 8.58 cm with a mean rate of propagation in air of 343 m/s. By an appropriate choice of size and angle of contingence of the acoustic manipulator element, the desired frequency may be reflected. In practice, dimensions of 3 to 35 cm for the reflecting surfaces may be used, wherein low frequencies having wavelengths greater than 35 cm are barely influenced.

Conventional sound influencing devices are used to focus sound waves in a centre and to supply these focused sound waves to a microphone. In these conventional devices, direct sound is received in direction of the sound axis, wherein for example interferences are avoided.

According to an embodiment of the invention, only specific portions of the sound are deflected or reflected and are supplied to a microphone in addition to direct portions of the sound. Further, the microphone does not have to be positioned in a focal point.

Figure 4A:
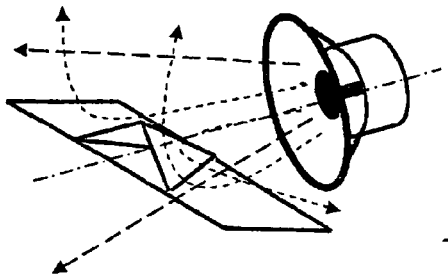
FIGS. 4*a* to 4*s* illustrate different forms of an acoustic manipulator element according to embodiments of the invention.
Figure 4B:
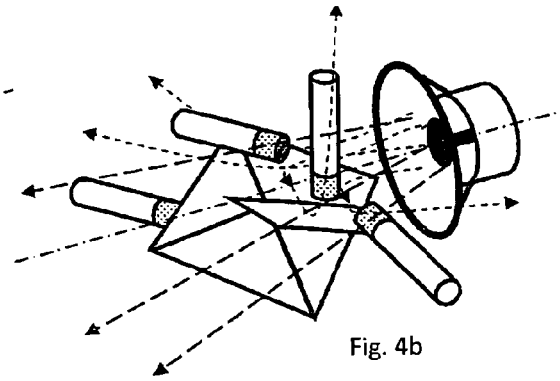

According to an embodiment of the invention illustrated in FIG. 4*a*, the acoustic manipulator element comprises a first element being rectangular-shaped and a second element comprising two triangle-shaped portions forming a pyramid-shaped attachment to the first element. The triangles are equilateral. Such a form may be used when a portion of the sound should be deflected sideward in an attenuated form. FIG. 4*b* illustrates a form of the acoustic manipulator element, wherein the first element is pyramid-shaped and wherein the second element is rectangular shaped and attached to the first element on top of the pyramid. The second element may be attached in the middle or on one side of the first element.

Figure 4C:
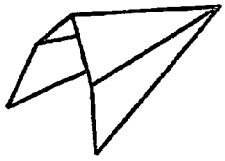
Figure 4D:
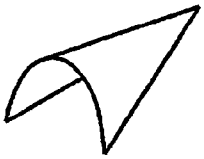

The acoustic manipulator element may be in the form of a hollow half cone (FIG. 4*d*) or may be half cone shaped, wherein the half cone is hollow and divided in two or more portions, wherein the portions are folded relatively to another (FIG. 4*c*). The cone may be symmetrical or unsymmetrical. It may also be more in the form of a pyramid having a basis in the form of a polygon. Both forms lead to a deflection being more diffuse than the form of FIG. 4*a*.

Figure 4E:
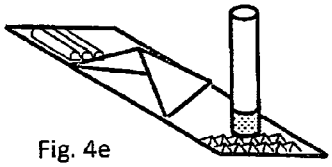

Further, a damping material may be applied to a surface of the acoustic manipulator element (FIG. 4*e*). The damping material may be in the form of small symmetrical forms, like small pyramids or small cylinder. The damping material may lead to a greater attenuation than the other forms. It may be applied to all forms additionally.

Figure 4F:
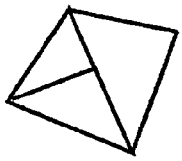
Figure 4G:
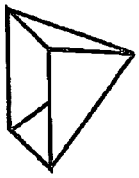
Figure 4H:
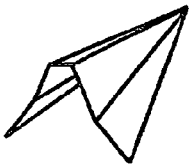
Figure 4I:
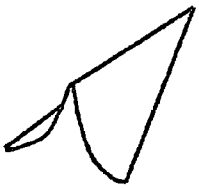
Figure 4J:
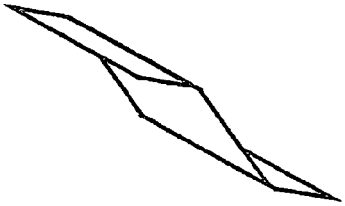
Figure 4K:
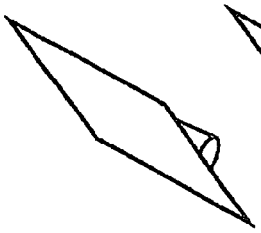
Figure 4L:
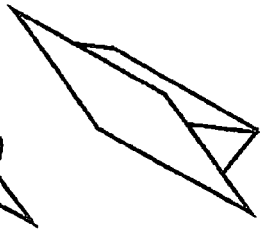
Figure 4M:
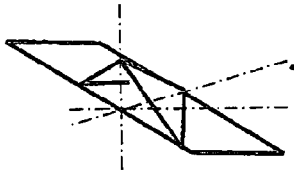
Figure 4N:
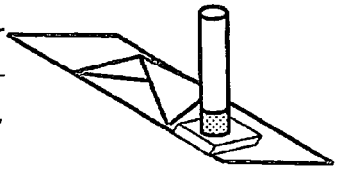

FIG. 4*f* shows an acoustic manipulator element in the form of a pyramid, wherein all surfaces are equilateral triangles and wherein one side is open. FIG. 4*g* shows an acoustic manipulator element in the form of a pyramid, wherein the side surfaces are isosceles triangles, wherein two sides are smaller than the others and wherein the bottom has the form of a rectangle and is open. The basis of each form may also be square. Each form comprising more than three surfaces may be used for splitting sound waves. FIG. 4*h* shows an acoustic manipulator element in the form of half cone like FIG. 4*c*. The half cone is composed of five isosceles triangles. An acoustic manipulator element may consist of two or more triangles, wherein each surface, edge and/or basis may be curved, for example concave or convex. The surface showing away from the sound or acoustic source may be open. FIG. 4*i* shows an acoustic manipulator element in the form of a pyramid, wherein the bottom or base and one side are open and wherein the remaining two sides are concave triangles. FIG. 4*j* shows an acoustic manipulator element in the form of a rectangle which is composed of one bigger and two smaller rectangles, wherein the two smaller rectangles are arranged at the edge and are folded in two opposite directions in an angle in respect to the bigger rectangle. The rectangles may be also quadrangles with different length of the edges and different angles in the vertices. FIG. 4*k* shows an acoustic manipulator element in the form of a rectangle, wherein a cylinder is attached to the rectangle. The cylinder may be full or hollow as this has no influence on the function of the cylinder. FIG. 4*l* shows an acoustic manipulator element in the form of a rectangle, wherein a hollow pyramid is attached to the rectangle. FIG. 4*m* shows an acoustic manipulator element in a form similar to FIG. 4*a*, wherein the triangles are not similar in size, but both equilateral. In other words, the triangles may have different sizes and may have different lengths of the edges. The open side of the pyramid is in the form of a not equilateral triangle, in contrast to FIG. 4*a*, where the open side has the form of an equilateral triangle. FIG. 4*n* shows an acoustic manipulator element in the form of a rectangle, wherein a diffuser is attached to the rectangle in addition to the pyramid of FIG. 4*a*. The diffuser has the form of a rectangular prism. If the microphone is attached directly to the diffuser, a slightly different sound may be generated by the slightly elevated position of the microphone in contrast to the direct attachment of the microphone to the base plate. In a different embodiment, all surfaces may comprise a damping material.

Figure 4O:
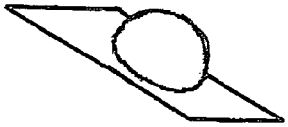
Figure 4P:
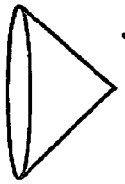
Figure 4Q:
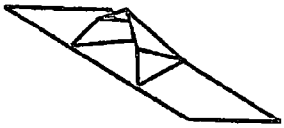
Figure 4R:
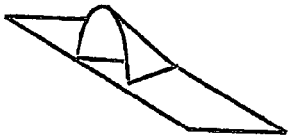

FIG. 4*o* shows an acoustic manipulator element comprising a portion of a sphere attached to a base plate. The portion of the sphere may be a hemisphere or more or less than a hemisphere. FIG. 4*p* shows an acoustic manipulator element in the form of a cone. The top of the cone may be oriented towards the acoustic source. The cone may be hollow or solid. FIG. 4*q* shows an acoustic manipulator element comprising a diffuser attached to a base plate. The diffuser may consist of, for instance four, triangles which are connected so that they form a kind of half cone. The surfaces, edges and or basis of the triangles may be curved. FIG. 4*r* shows a form like FIG. 4*q*, wherein the diffuser forms a half cone instead of composed triangles. Also the lateral surfaces of this diffuser may be curved (for instance convex or concave). The top of the kind of cone may be oriented towards the acoustic source. The smaller the surface is, to which the microphone is oriented, the higher the reflected frequencies are.

Figure 4S:
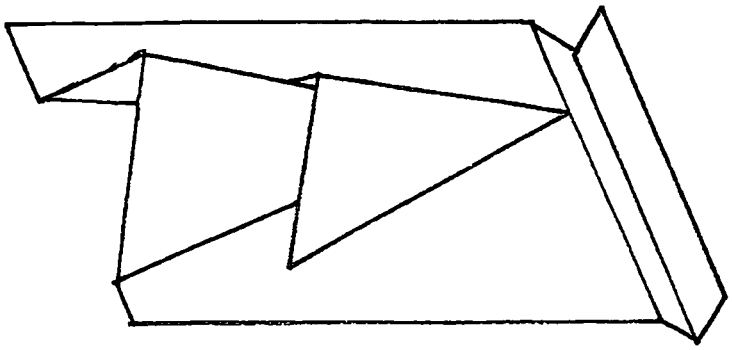

FIG. 4*s* illustrates a further embodiment of an acoustic manipulator element. In this embodiment, the acoustic manipulator element comprises a first element being rectangular-shaped. The first element comprises a triangle shaped cut out at one side. On top of this triangle shaped cutout, a second element comprising two triangle-shaped portions forming a pyramid-shaped attachment to the first element is arranged. The triangles may be equilateral. The open side of the second element may match substantially with the cut out. Such a form may be used when a portion of the sound should be deflected sideward in an attenuated form.

The first element in this embodiment may have dimensions of a length in a range of 40 cm to 60 cm and a width in a range of 20 cm to 40 cm. The dimensions may further be about 50 cm by 30 cm, in particular 51 cm by 30 cm. The cut out in the form of a triangle may have a base in a range of 10 cm to 30 cm, for example about 20 cm, in particular 23 cm, and a height in a range of 30 cm to 50 cm, for example of about 40 cm, in particular 42 cm. The second element may have a height in a range of 40 cm to 60 cm, for example of about less than 50 cm, in particular 49 cm, and the length of the diagonal of the base may be in the range of 10 cm to 30 cm, for example about 25 cm, in particular 27 cm.

A third element may be used as a further diffuser which is attached to the first element. The third element is also pyramid shaped. The second and the third element may be nested. The third element may be arranged overlapping the second element at least partially. The top of the second element and the top of the third element may be arranged adjacently or next to each.

The second element may be used as diffuser for sound sources in a defined height and the third element may be used as diffuser for sound sources in a second height which is lower than the defined height. Thus, the same acoustic manipulator element may be used for different loudspeakers or loudspeaker systems comprising more than loudspeaker arranged in different heights.

The base plate may also have a length of more than 60 cm, for example more than 100 cm, to be used for loudspeakers of a higher height. Also two or more acoustic manipulator elements may be arranged one superimposed on the other. Such an arrangement may be formed by using for example a tripod or stand.

The acoustic manipulator element may comprise a pedestal as shown in FIG. 4*s*. The first element may comprise an extension on one side. The extension may have a smaller width than the first element. The extension may consist of two portions. The first portion may be angled in respect to the first element, for example by a first angle in the range of 130 degree to 150 degree, in particular 140 degree. The second portion may be angled in respect to the first portion, for example by a second angle in the range of 80 degree to 110 degree, in particular 90 degree. The directions of the angles are opposite to each other. For example, the first angle may be positive and the second angle may be negative. The second portion may then be positioned on the ground. The angle of the first element in respect to the sound source may then be for example in the range of 20 degree to 70 degree, as the first and the second angle compensate each other partially.

Figure 5A:
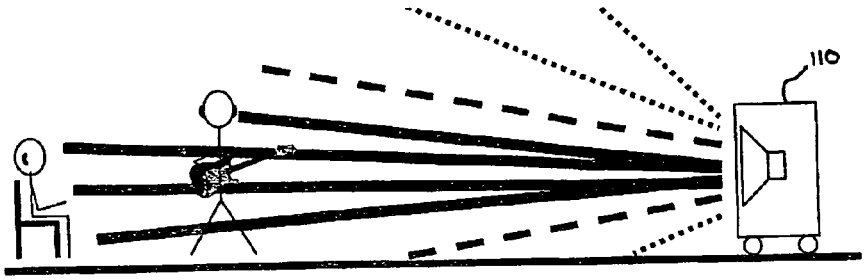
FIG. 5*a* to FIG. 5*c* illustrate an auditor being exposed to a sound source.
Figure 5B:
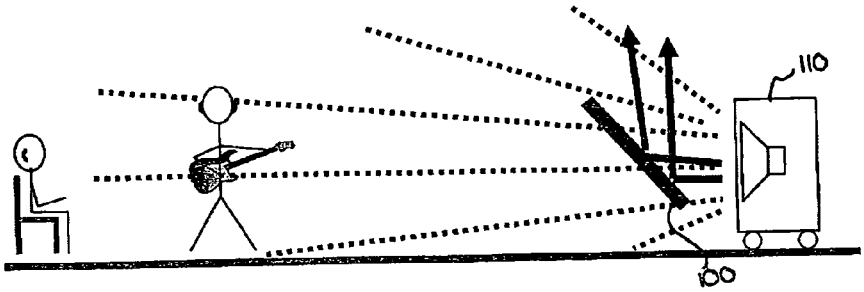
Figure 5C:
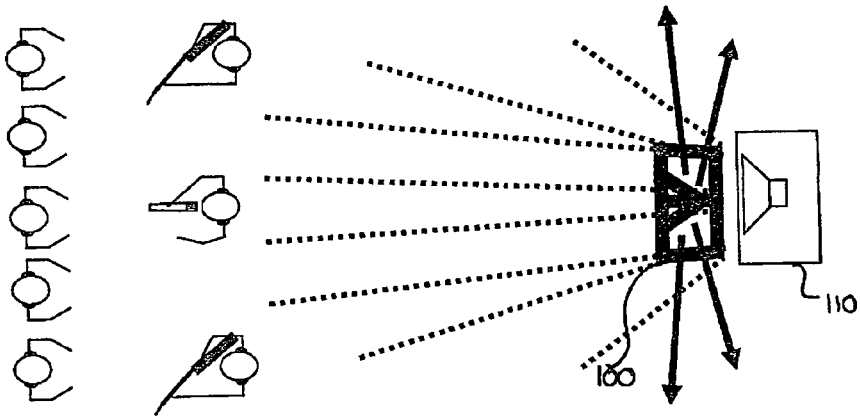

FIG. 5*a* to FIG. 5*c* illustrates an auditor (guitar player) being exposed to a sound source. In FIG. 5*a*, the auditor is exposed directly to all frequencies originating from a sound source. Due to the directed sound emission, the guitar player receives a shrill sound. In FIG. 5*b*, when using the acoustic manipulator element, the auditor receives a more comfortable sound as desired frequencies leading to a shrill sound are deflected or diffusely dispersed into directions where no auditor is positioned. By using the acoustic manipulator element according to the invention, a balanced sound may be achieved in a great size of the environment (FIG. 5*c*).

Figure 6A:
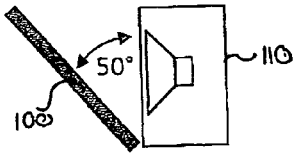
FIGS. 6*a*, 6*b* and 7 illustrate an arrangement of an acoustic manipulator element according to embodiments of the invention.
Figure 6B:
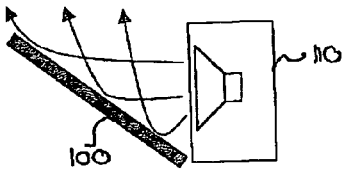

According to an embodiment of the invention, illustrated in FIG. 6*a*, the acoustic manipulator element comprises a base plate 100 being arranged relative to the sound source 110 in a specific angle for reducing a sound level of the sound waves. The angle between base plate and the sound source may vary. A flat angle may reduce the sound level in a slight extent. A sharper angle may enhance the attenuation of the noise level, the interferences between sound source and acoustic manipulator element may increase and the sound may thus be noticeable distorted. A preferred angle may be 50°, as shown. FIG. 6*b* shows a side view of the embodiment of FIG. 6*a*. It is shown that the sound waves or at least a part of the frequencies of the sound waves is reflected to one side of the sound axis.

Figure 7:
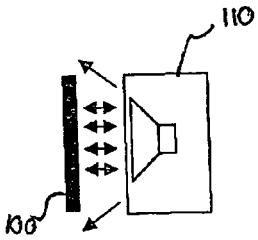

As shown in FIG. 7, if the acoustic manipulator element 100 is arranged immediately in front of the acoustic source 110, the interferences may increase due to the repeated reflection between sound source or acoustic source and the acoustic manipulator element and the sound may be distorted.

Figure 8C:
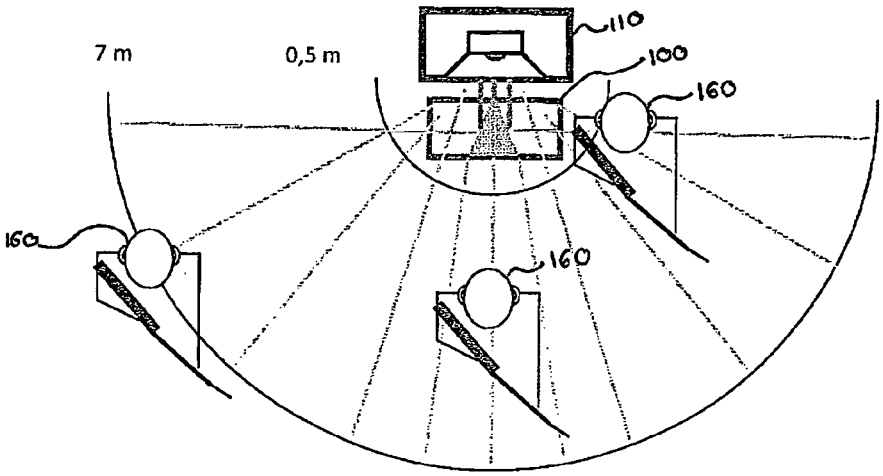
FIGS. 8*a*, 8*b* and 8*c* illustrate further arrangements of an acoustic manipulator element according to embodiments of the invention.
Figure 8A:
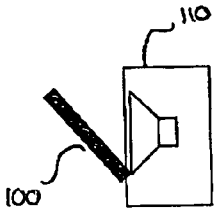
Figure 8B:
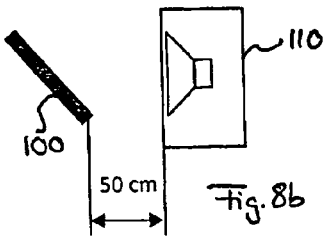

In an embodiment, the top edge of the acoustic manipulator element is positioned at least higher than the centre of the sound source. The width of the acoustic manipulator element is greater than 17 cm, the wavelength of 2000 Hz is 17.2 cm. The distance from the acoustic manipulator element 100 is in the range of 0 cm (FIGS. 8*a*) to 50 cm (FIG. 8*b*). The auditor 160 has the impression that, in a range of 180° in a distance of 2 to 7 meters in front of the sound or acoustic source 110, illustrated in FIG. 8*c*, the sound is uniform or smooth. This impression is independent from the distance of the acoustic manipulator element 100 to the acoustic source. Higher frequencies are more softly than in the direct sound axis. If the distance is smaller, the amount of high frequencies increases.

Figure 9B:
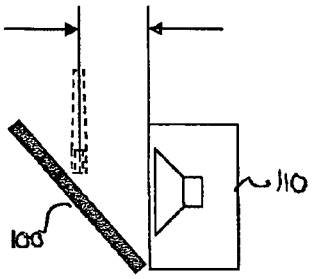
FIGS. 9*a* and 9*b* illustrate further arrangements of an acoustic manipulator element according to embodiments of the invention.
Figure 9A:
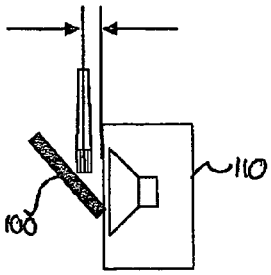

If the acoustic manipulator element is used for miking, the distance of the acoustic manipulator element to the sound source may be smaller (FIG. 9*a*) than if used for providing sound to an auditor (FIG. 9*b*). The acoustic manipulator element may be height-adjustable for being adaptable to different heights of the sound source.

Figure 10:
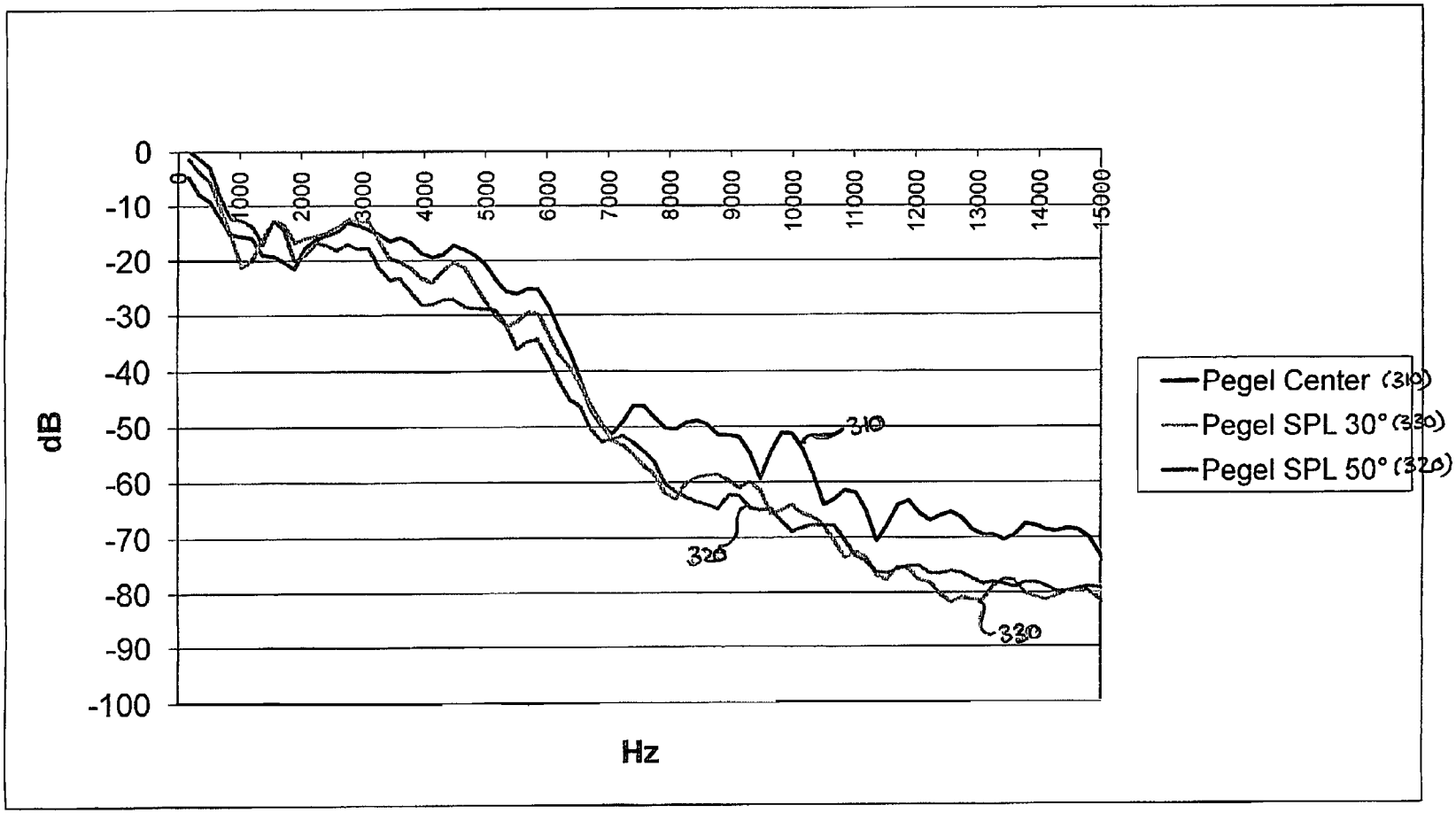
FIG. 10 illustrates a frequency diagram for sound waves of a sound source.

FIG. 10 illustrates a frequency diagram for sound waves of a sound source without (310) acoustic manipulator element, with acoustic manipulator element arranged at an angle of 30° (330) and arranged at an angle of 50° (320). It may be clearly seen that the use of the acoustic manipulator element leads to a significant attenuation of the sound level, in the used specific embodiment especially starting from 3000 Hz. For other embodiments, the attenuation may start especially from 2000 Hz. The acoustic manipulator element serves as low-pass filter. The signal which is not manipulated shows notably an increase of the shrill, uncomfortable frequencies. The acoustic manipulator element with an angle of 30° shows a smaller attenuation than the acoustic manipulator element with an angle at 50°. It may be seen that the use of the acoustic manipulator element attenuates the sound waves of a sound source by at most 15 dB (graphs 320, 330) compared to the sound waves without the use of the acoustic manipulator element (graph 310).

Figure 10A:
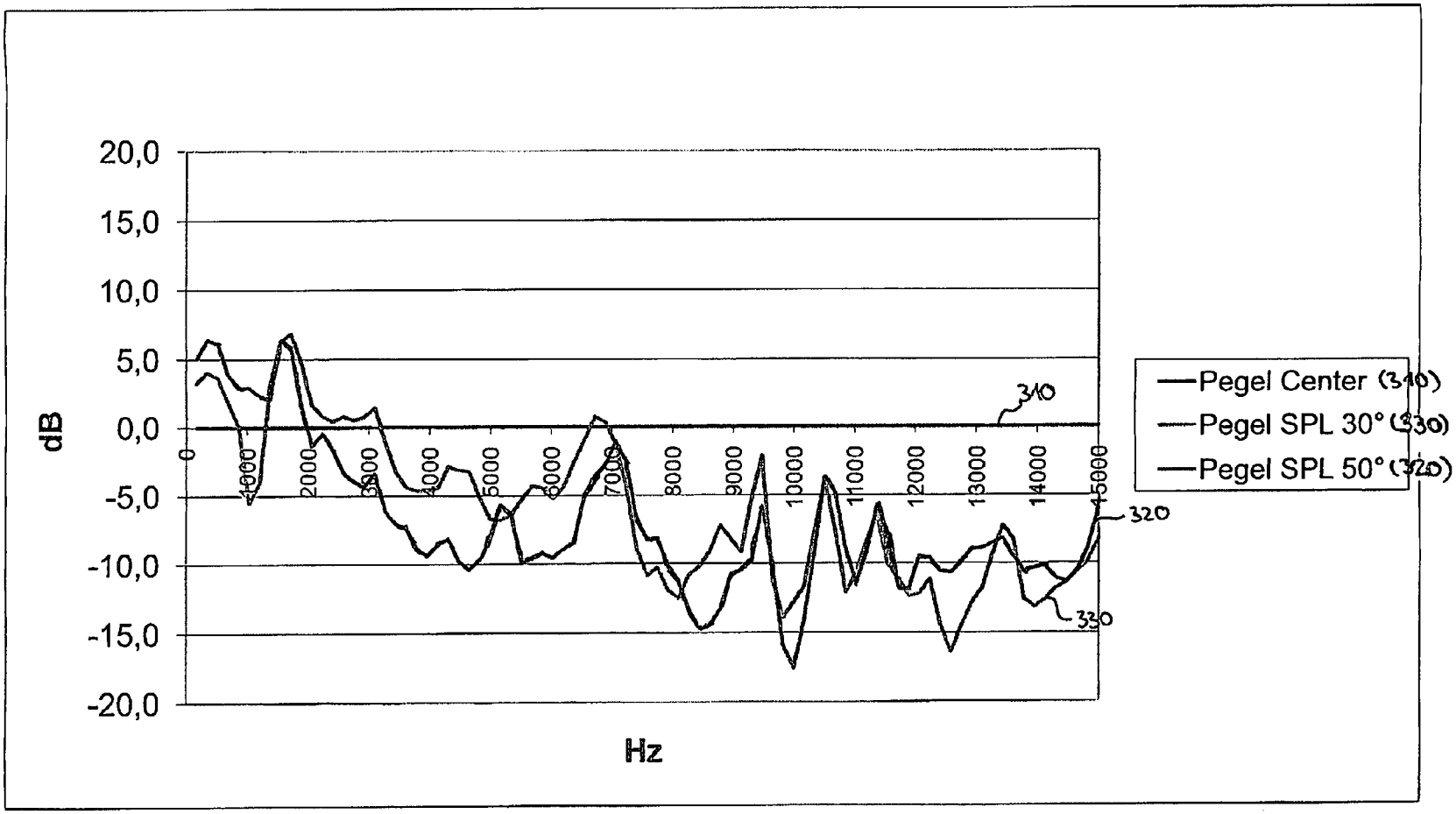
FIG. 10*a* illustrates a further frequency diagram for sound waves of a sound source.

This may also be seen in FIG. 10*a*, wherein the attenuation of the sound waves (320, 330) is shown when the acoustic manipulator element is used, wherein the sound level of the sound waves without manipulating is shown as basis of 0 dB.

Figure 11A:
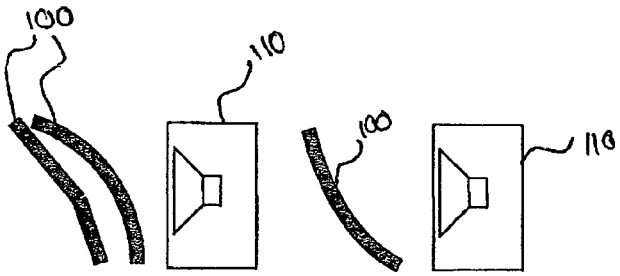
FIG. 11*a* and 11*b* illustrate an embodiment of an acoustic manipulator element according to the invention.
Figure 11B:
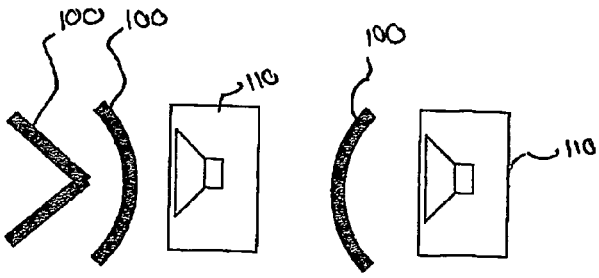

FIG. 11*a* illustrates side view of an acoustic manipulator element according to an embodiment of the invention, wherein the base plate is curved or wherein the base plate comprises at least two portions, wherein the at least two portions are arranged with a gap. FIG. 11*b* illustrates a top view of the embodiment of FIG. 11*a*.

Figure 12A:
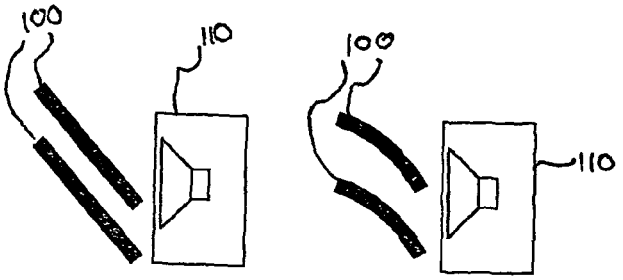
FIGS. 12*a* and 12*b* illustrate an embodiment of an acoustic manipulator element according to the invention.
Figure 12B:
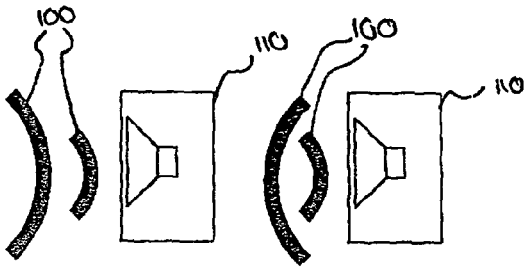

FIG. 12*a* illustrates a side view of an acoustic manipulator element according to an embodiment of the invention, wherein acoustic manipulator element comprises two base plates, which are arranged relatively to another and which may be curved. FIG. 12*b* illustrates a top view of the embodiment of FIG. 12*a*. The two base plates may have different sizes. The channel, which is formed between the plates or elements, may be used for a directed deflection or diversion (focusing) of the sound. If the distance between the elements is increased, an amplification effect or trumpet effect may occur. If the distance is decreased, the distance may act as a damper or attenuator. In addition, interferences may occur which may be used for example for miking.

Figure 13A:
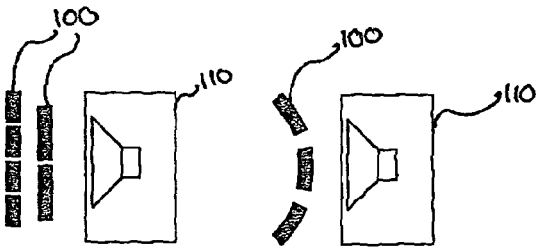
FIGS. 13*a* and 13*b* illustrate an embodiment of an acoustic manipulator element according to the invention.
Figure 13B:
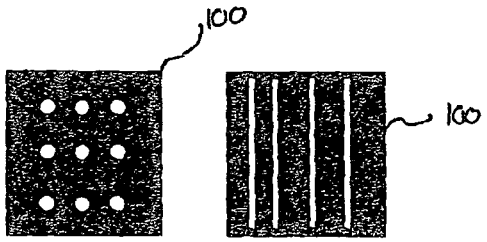

FIG. 13*a* illustrates a side view of an acoustic manipulator element according to an embodiment of the invention, wherein the acoustic manipulator element comprises two base plates (left side) or one base plate which is curved. The base plates comprise apertures so that a specific portion of the frequencies may pass without diffraction. FIG. 13*b* illustrates a top view of the embodiment of FIG. 13*a*.

Figure 14:
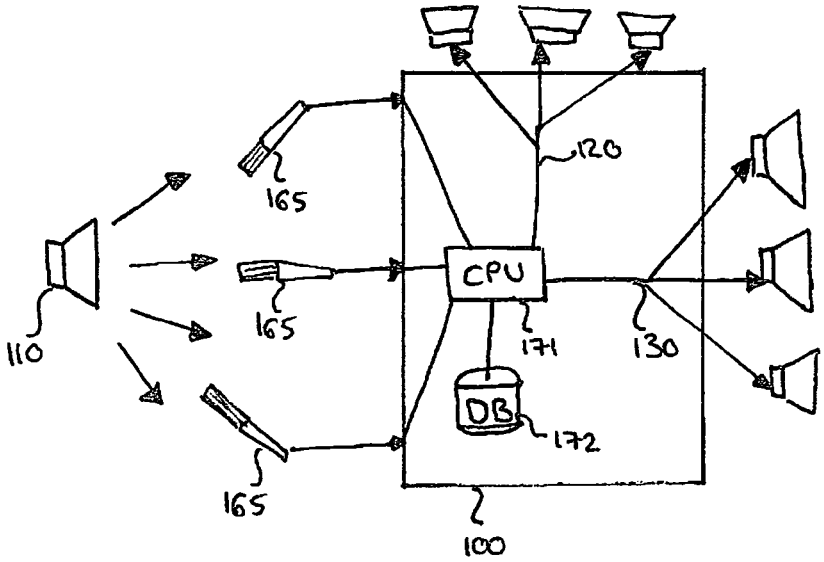
FIG. 14 illustrates an embodiment of an acoustic manipulator element simulated by a software device according to the invention.

FIG. 14 illustrates an embodiment of a software implementation according to the invention simulating the performance of an acoustic manipulator element as described above. In this embodiment, sound waves originating from a loudspeaker 110 or any other sound source are recorded by a plurality of microphones 165. The recorded sound waves are transferred into a digital signal which is sent for example to a computer 100 comprising a program element being adapted to simulate the acoustic manipulator element or a method for manipulating sound waves according to the invention, respectively. The digital signal comprises information about the characteristics of the sound waves originating from the sound source, like frequency ranges, intensities and so on.

Instead of sound waves originating from a loudspeaker and recorded by a plurality of microphones, any device like an instrument, for example an electric guitar, may be coupled directly with the computer 100. The analog signal originating from the device may be converted into a digital signal by an A/D converter comprised in the computer. The program element may be adapted for simulating also microphones and loudspeakers so that it may also be simulated that sound waves originating from an instrument are recorded.

The computer comprises at least a CPU 171 which is connected to a data base 172. The data base may comprise information about the characteristics of the acoustic manipulator element, that means information of how the acoustic manipulator element physically manipulates sound waves. For example reverb characteristics are stored in the data base. Thus, the data base comprises also information about characteristics of portions of sound waves, which would be attenuated and transmitted through the acoustic manipulator element and of portions of sound waves, which would be reflected by the acoustic manipulator element. The information about the acoustic manipulator element may be stored by using one of the above mentioned methods, i.e. using impulse responses or sweep.

The CPU is adapted for determining and generating signals comprising information being equivalent to information of the manipulation of sound waves. The digital signal is processed by using this information. The processed signal is then divided into a signal corresponding to a reflected component and a signal corresponding to a through component, similar to the process of a physical acoustic manipulator element. These signals are converted into analog signals and are then output to a plurality of loudspeakers, for example an array of loudspeakers. The loudspeakers may be divided into loudspeakers for outputting signals, i.e. sound waves, corresponding to the reflected component 120 and loudspeakers for outputting signals, i.e. sound waves, corresponding to the through component 130.

The signals generated by the CPU are digital signals comprising information about analog signals corresponding to a reflected component signal and to a trough component signal. The digital signals are transformed into analog acoustic signals for being output by the plurality of loudspeakers.

Instead of being output by the plurality of loudspeakers, the digital signals may be used directly for recording. The loudspeakers may be comprised in the program element or software implementation as simulation. Also, only a part of the different components, i.e. reflected and/or transmitted components, may be output as analog signals.

The use of the described software device is equivalent to the use of a physical acoustic manipulator element. Instead of the acoustic manipulator device, a processing or software device may be used, for example a computer, in which the acoustic manipulator element is simulated. Such a simulation may be included for example in existing software programs as a plug in. With this embodiment, the acoustic manipulator element and the method for splitting sound waves in a reflected and a through component according to the invention may be simulated. A computer-readable medium or a program element according to the invention may be adapted to carry out or control such a method, for example by the described simulation.

It should be noted that the term "comprising" does not exclude other elements or features and the "a" or "an" does not exclude a plurality. Also elements described in association with different embodiments may be combined. It should also be noted that reference signs in the claims shall not be construed as limiting the scope of the claims.

The invention claimed is:

1. Acoustic manipulator element being arrangable relatively to the acoustic source in a manner that the acoustic manipulator element selectively splits sound waves originating from the acoustic source in a reflected and a through component, wherein the acoustic manipulator element comprises a first element as base plate and a second element attached to the first element as diffuser, wherein the first element comprises a triangle-shaped cutout, wherein the second element is pyramid-shaped with an open bottom and one open side surface, wherein the second element is attached to the first element such that the open bottom of the second element corresponds to the cutout of the first element, and wherein at least a portion of the acoustic waves of the through component is attenuated by at most 15 dB for acoustic frequencies between 200 Hz and 15000 Hz compared to the sound waves of the acoustic source.

2. Acoustic manipulator element according to claim 1, wherein a damping material is applied to a surface of the acoustic manipulator element.

3. Acoustic manipulator element according to claim 1, wherein the acoustic manipulator element is adapted for providing the reflected component to a microphone.

4. Acoustic manipulator element according to claim 1, wherein the acoustic manipulator element is adapted for providing the through component to an auditor.

5. Method for splitting sound waves by an acoustic manipulator element into a reflected and a through component, the method comprising:

encountering, with the acoustic manipulator element, sound waves produced by an acoustic source;

splitting frequency selectively sound waves originating from an acoustic source in a reflected and a through component by the acoustic manipulator element having a first element as base plate and a second element attached to the first element as diffuser, wherein the first element comprises a triangle-shaped cutout, wherein the second element is pyramid-shaped with an open bottom and one open side surface, wherein the second element is attached to the first element such that the open bottom of the second element corresponds to the cutout of the first element, and wherein at least a portion of the acoustic waves of the through component is attenuated by at most 15 dB for acoustic frequencies between 200 Hz and 16000 Hz compared to the sound waves of the acoustic source.

6. A non-transitory computer-readable medium, in which a computer program of splitting sound waves in a reflected and a through component is stored, which computer program, when being executed by a processor, is adapted to carry out or control a method for splitting sound waves in a reflected and a through component, the method comprising splitting frequency selectively sound waves originating from an acoustic source in a reflected and a through component to thereby simulate the acoustic effects of an acoustic manipulator element, which comprises a first element as base plate and a second element attached to the first element as diffuser, by the use of software.

7. The computer-readable medium according to claim 6, wherein at least a portion of the acoustic waves of the through component is attenuated by at most 15 dB for acoustic frequencies between 200 Hz and 16000 Hz compared to the sound waves of the acoustic source.

8. A method for splitting sound waves originating from an acoustic sound source, the method comprising:

receiving a digital signal representative of the acoustic sound source;

processing the digital signal with a processor;

dividing the digital signal into a reflected component and a through component to simulate acoustic effects of an acoustic manipulator element, which comprises a first element as base plate and a second element attached to the first element as a diffuser, by the use of an informational model that characterizes sound waves that would be attenuated and transmitted through the acoustic manipulator element and of portions of sound waves that would be reflected by the acoustic manipulator element;

converting the reflected component and the through component to analog signals; and applying the analog signals to loudspeakers for generating sound waves corresponding to the reflected component and the through component.

9. The method according to claim 8, wherein at least a portion of the sound waves are attenuated by at most 15 dB for frequencies between 200 Hz and 16000 Hz.

10. Acoustic manipulator element according to claim 1, wherein the base plate is arranged relative to the sound source in a specific angle for reducing a sound level of the sound waves.

* * * * *